US009147922B2

(12) United States Patent
Rhodes et al.

(10) Patent No.: US 9,147,922 B2
(45) Date of Patent: Sep. 29, 2015

(54) ELECTRICAL FILTER

(75) Inventors: John David Rhodes, Menston (GB); Christopher Mobbs, Menston (GB)

(73) Assignee: FILTRONIC WIRELESS LIMITED, Shipley (GB)

( * ) Notice: Subject to any disclaimer, the term of this patent is extended or adjusted under 35 U.S.C. 154(b) by 447 days.

(21) Appl. No.: 13/520,646

(22) PCT Filed: Jan. 5, 2011

(86) PCT No.: PCT/GB2011/050006
§ 371 (c)(1),
(2), (4) Date: Aug. 8, 2012

(87) PCT Pub. No.: WO2011/083325
PCT Pub. Date: Jul. 14, 2011

(65) Prior Publication Data

US 2012/0293275 A1 Nov. 22, 2012

(30) Foreign Application Priority Data

Jan. 6, 2010 (GB) ..... 1000228.5

(51) Int. Cl.
*H01P 1/208* (2006.01)
*H01P 1/38* (2006.01)
*H01P 1/20* (2006.01)

(52) U.S. Cl.
CPC *H01P 1/208* (2013.01); *H01P 1/20* (2013.01); *H01P 1/38* (2013.01)

(58) Field of Classification Search
CPC ..... H01P 1/20; H01P 1/205; H01P 1/208; H01P 1/38
USPC ..... 333/1.1, 24.2, 132, 202
See application file for complete search history.

(56) References Cited

U.S. PATENT DOCUMENTS 4,360,793 A 11/1982 Rhodes et al.
5,739,733 A 4/1998 Cameron
5,781,084 A 7/1998 Rhodes
(Continued)

FOREIGN PATENT DOCUMENTS

EP 0736923 A1 10/1996
GB 2284940 A 6/1995
(Continued)

OTHER PUBLICATIONS

Great Britain Search Report, Application No. GB1100077.5, May 3, 2011, 4 pages.
International Search Report, Application No. PCT/GB2011/050006, Apr. 13, 2011, 3 pages.

*Primary Examiner* — Benny Lee
*Assistant Examiner* — Jorge Salazar, Jr.
(74) *Attorney, Agent, or Firm* — Howard & Howard Attorneys PLLC

(57) ABSTRACT

An electrical filter for filtering an electrical signal, the filter having a transmission characteristic comprising a band edge at a band edge transition frequency, the filter comprising a circulator having a first circulator port for receiving a signal to be filtered, the circulator being adapted to transfer a signal received at the first circulator port to a second circulator port and being further adapted to transfer a signal received at the second circulator port to a third circulator port; and, a reflection mode filter connected to the second port; the reflection mode filter comprising a filter network comprising at least one resonator, the filter network having a network input connected to the second circulator port; and, a further resonator connected to the network input, the further resonator being arranged to provide an extracted pole providing a transmission zero closest to the band edge transition frequency; wherein the further resonator has a high Q compared to the low Q of at least one of the at least one resonator of the filter network.

18 Claims, 13 Drawing Sheets

(56) References Cited

U.S. PATENT DOCUMENTS

| | | | | |
|---|---|---|---|---|
| 6,529,750 | B1 | 3/2003 | Zhang et al. | |
| 7,782,158 | B2 | 8/2010 | Wiehler | |
| 2003/0197577 | A1 | 10/2003 | Hershtig | |
| 2005/0073378 | A1* | 4/2005 | Smith et al. | 333/202 |
| 2008/0129411 | A1* | 6/2008 | Beaudin et al. | 333/133 |
| 2008/0252399 | A1 | 10/2008 | Wiehler | |

FOREIGN PATENT DOCUMENTS

| | | | |
|---|---|---|---|
| GB | 2359197 | A | 8/2011 |
| WO | W001/65631 | A1 | 9/2001 |
| WO | W02010/028450 | A1 | 3/2010 |

* cited by examiner

ELECTRICAL FILTER

RELATED APPLICATIONS

This application claims priority to and all the advantages of International Patent Application No. PCT/GB2011/050006, filed Jan. 5, 2011, with the World Intellectual Property Organization, which claims priority to Great Britain Patent Application No. 1000228.5, filed on Jan. 6, 2010. These applications are hereby expressly incorporated by reference.

FIELD OF THE INVENTION

The present invention relates to an electrical filter. More particularly, but not exclusively, the present invention relates to an electrical filter comprising a circulator having a reflection mode filter connected thereto, the refection mode filter comprising a filter network comprising at least one resonator and a further resonator connected to the filter network and adapted to provide an extracted pole, the Q of the further resonator being high as compared to the low Q of the at least one resonator of the filter network. More particularly, but not exclusively, the present invention provides an electrical filter having a second reflection mode filter connected to the circulator in parallel with the first to provide a passband in the transmission characteristic of the electrical filter.

BACKGROUND OF THE INVENTION

All passive resonators have a finite unloaded Q factor. In narrow bandwidth applications this resistive loss can lead to difficulties in the design process. In a bandpass application, designs which provide for both a good input and output match will exhibit transfer characteristics with significant amplitude variation over the passband if mid-band loss is minimised. This passband variation can only be reduced with given Q factors if the mid-band loss is increased possibly to an unacceptable level. Even in the case of a single resonator filter, problems occur due to the resistive loss which prevents a good input and output match being simultaneously achievable.

In the case of a rapid transition from passband to stopband, the resistive loss of the resonators causes a roll off of the insertion loss into the passband. A reduction in unloaded Q can quickly cause this loss to reach an unacceptable level particularly where noise figure is important and the filter has been introduced to reject signals which would limit the dynamic range of the receiver. This requirement now exists in several countries where new cellular telephone frequency bands have multi-use configurations such as that which arises in the refarming of terrestrial television bands.

In conventional filters, each resonator couples loss into the system. To meet typical requirements at least 25 dB rejection has to be provided over a band in excess of several MHz whilst the loss at 0.5 MHz into the passband has to be less than 0.5 dB. To achieve this, unloaded Q's of greater than 20,000 are required resulting in the necessity, at microwave frequencies, to use dielectric resonators for all of the cavities resulting in a physically large, heavy and expensive filter.

SUMMARY OF THE INVENTION

The present invention seeks to overcome the problems of the prior art.

Accordingly, the present invention provides an electrical filter for filtering an electrical signal, the filter having a transmission characteristic comprising a band edge at a band edge transition frequency, the filter comprising a circulator having a first circulator port for receiving a signal to be filtered, the circulator being adapted to transfer a signal received at the first circulator port to a second circulator port and being further adapted to transfer a signal received at the second circulator port to a third circulator port; and, a reflection mode filter connected to the second port;

the reflection mode filter comprising a filter network comprising at least one resonator, the filter network having a network input connected to the second circulator port; and, a further resonator connected to the network input, the further resonator being arranged to provide an extracted pole providing a transmission zero closest to the band edge transition frequency;

wherein the further resonator has a higher Q than the Q of at least one of the at least one resonator of the filter network.

The electrical filter requires only one high Q resonator per band edge transition frequency adapted to provide a transmission zero closest to the band edge in order to meet performance requirements. The remainder of the resonators can be low Q without any significant loss of performance. This results in a significant cost saving in the manufacture of the electrical filter along with a considerable reduction in filter size and weight.

Preferably, the electrical filter comprises electrical signal generator connected to the first circulator port of the circulator.

The filter network can comprise a single resonator.

The filter network can comprise a plurality of resonators, preferably at least three resonators.

Preferably, the Q of the further resonator is higher than the Q of each of the resonators of the filter network.

At least one of the resonators of the filter network can be a combline resonator.

Preferably, the filter network comprises at least one resistor, preferably a load resistor.

The filter network can comprise at least one impedance inverter.

Preferably, the electrical filter comprises a second reflection mode filter connected to the same second circulator port of the circulator, the resonators of the second reflection mode filter being adapted such that the transmission characteristic of the electrical filter has first and second band edges defining a passband therebetween.

BRIEF DESCRIPTION OF THE DRAWINGS

The present invention will now be described by way of example only and not in any limitative sense with reference to the accompanying drawings in which

FIG. 3(*b*) shows the reflection mode filter of the filter of FIG. 3(*a*) in more detail;

FIG. 9(*b*) shows the two reflection mode filters of the embodiment of FIG. 9(*b*) in more detail;

DETAILED DESCRIPTION OF THE INVENTION

Figure 1:
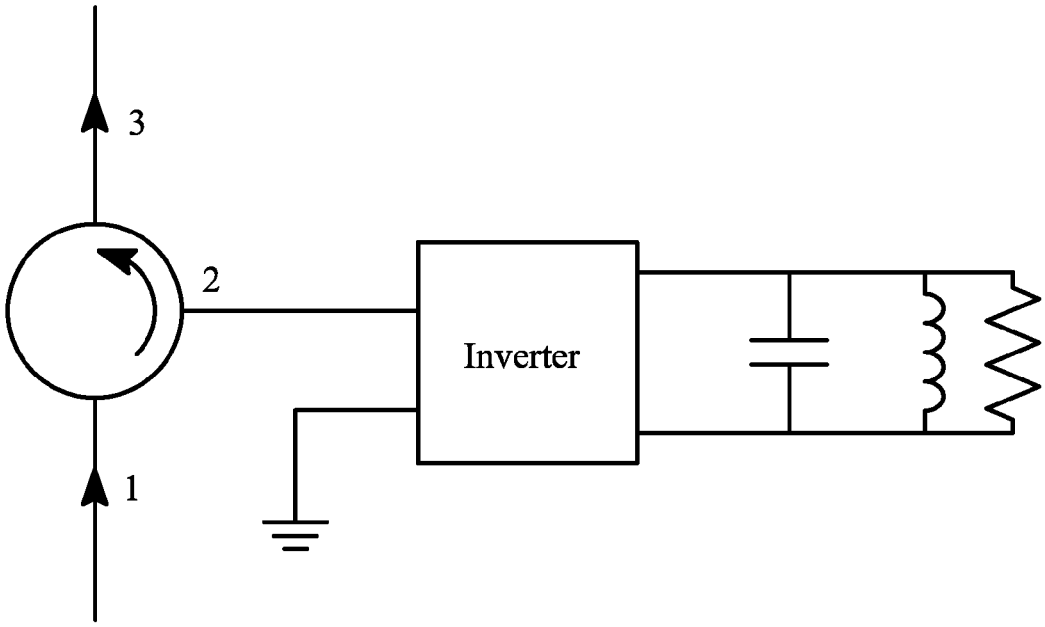
FIG. 1 shows a filter comprising a resonant circuit with loss coupled to one of the ports of a circulator.

FIG. 1 shows a filter comprising a resonant circuit with loss coupled to one of the ports of a circulator. The transmission characteristic from ports 1 and 3 is the reflection characteristic from the network connected to port 2. Assume that the coupling into the resonant circuit is adjusted such that the resistive part at resonance is matched to the impedance of the circulator. Thus, at resonance, all of the power supplied at port 1 will emerge at port 2 and be absorbed in the resistive part of the resonator. Hence, there is no transmission to port 3. In this case the transmission characteristic from ports 1 to 3 is of a single resonator with an infinite unloaded Q. If fo is the centre frequency and B the 3 dB bandwidth of the resonance, then by a simple calculation the unload Q of the resonator Qu is given by $$Qu = \frac{2fo}{\beta}$$

For example if B=250 KHz and fo=1 GHz then Qu=8000. This implies that the type of specification previously considered could be met with cavities of much lower Qu if a design procedure could be established for a multi-element filter.

Papers have been published on multi-element designs but require the use of separate resistances, thus increasing overall reflected loss e.g. Rhodes J D and Hunter I C 'Synthesis of Reflection—mode prototype networks with dissipative circuit elements' IEE Proceedings on Microwave, Antennas and Propagation, 1997 Vol 144 (6) pp 437-42' and 'Fathellob, W M, Hunter I C and Rhodes J D, 'Synthesis of lossy reflective-mode prototype network with symmetrical and asymmetrical characteristics' ibid 1999 Vol 146 (2) pp 97-104. This work was summarised in the book 'Theory and Design of Microwave Filters' Ian Hunter 2004 IEE ISBN 085296 777 2, pp 327-344

Figure 2:
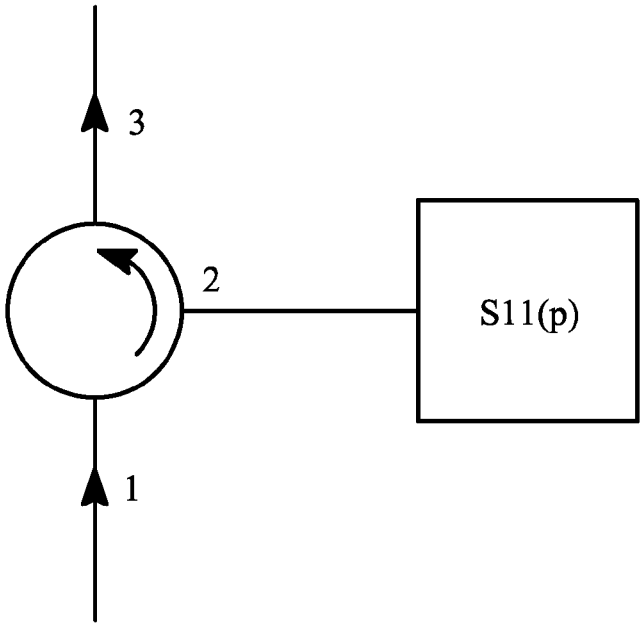
FIG. 2 shows a basic network.

The basic network is shown in FIG. 2 and it is required to design the appropriate reflection coefficient S11(p) to provide the low-loss, highly selective bandpass frequency response between ports 1 and 3. A synthesis procedure was established in 1980 using extracted poles. 'Rhodes J D and Cameron R J. 'General Extracted Pole Synthesis Technique with applications to low loss TE011 mode filters' IEEE Transactions of Microwave Theory and Techniques, 1980. Vol 28(9) pp 1018-28. This design uses an extracted pole at the input to the network producing the transmission zero closest to the band edge transition frequency.

Figure 3A:
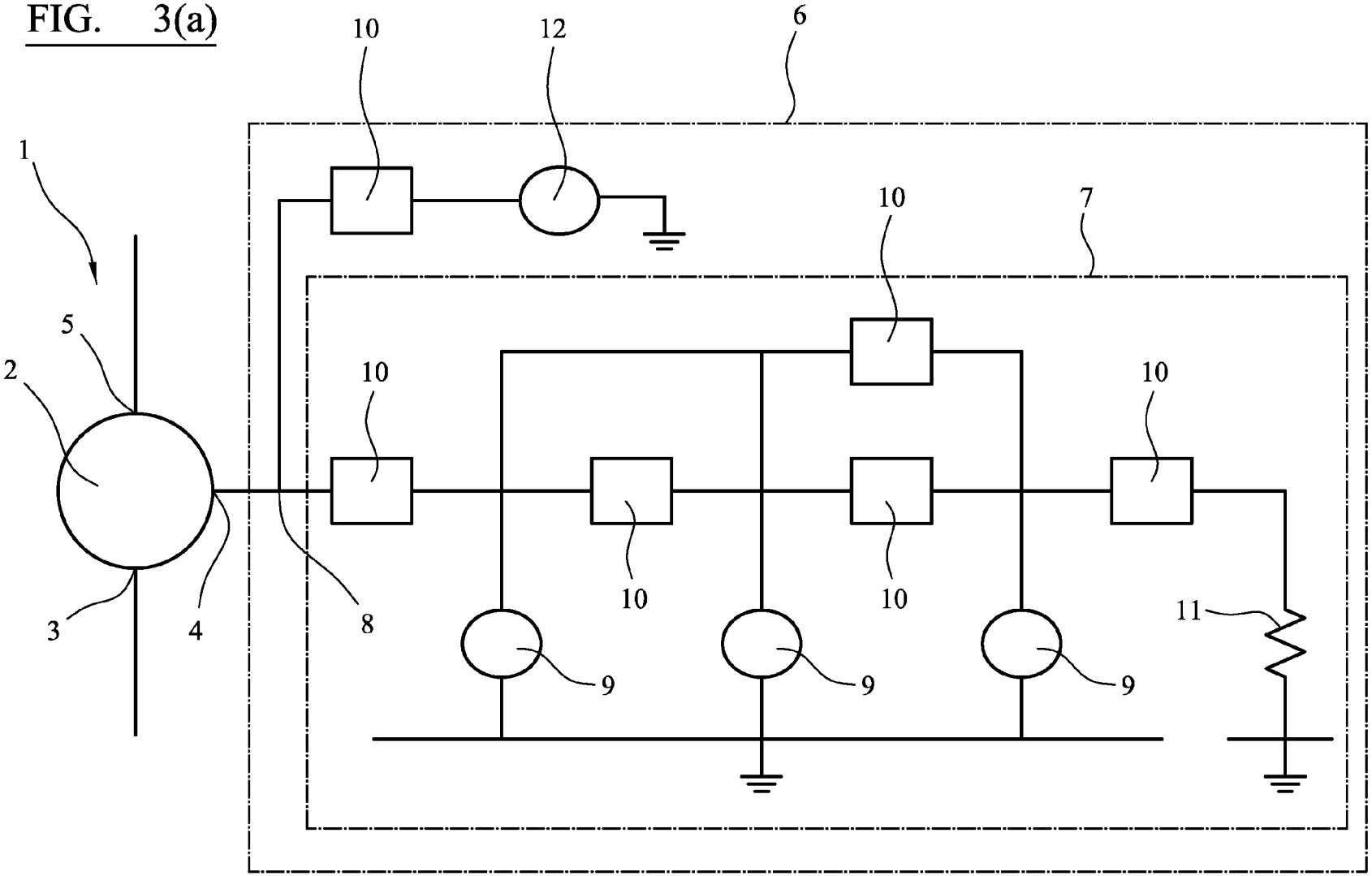
FIG. 3(*a*) shows an electrical filter comprising a reflection mode filter in schematic form.

FIG. 3(*a*) shows in schematic form an electrical filter 1. The electrical filter 1 has a transmission characteristic comprising a band edge at a band edge transition frequency. The electrical filter 1 comprises a circulator 2 having a first circulator port 3 for receiving an electrical signal to be filtered. The circulator 2 is adapted to pass signals received at the first circulator port 3 to a second circulator port 4 and signals received at the second circulator port 4 to a third circulator port 5.

Connected to the second circulator port 4 is a reflection mode filter 6. The refection mode filter 6 comprises a filter network 7 having a network input 8 connected to the second circulator port 4. The filter network 7 comprises a plurality (in this case three) of resonators 9. The filter network 7 further comprises impedance inverters 10 and a resistor 11, the function of which is well known to one skilled in the art of filter design.

The reflection mode filter 6 further comprises a further resonator 12 connected to the network input. The further resonator 12 is arranged to provide an extracted pole providing a transmission zero closest to the band edge transition frequency.

The reflection mode filter 6 of the electrical filter 1 of FIG. 3(*a*) is shown in more detail in FIG. 3(*b*). The reflection mode filter 6 of FIG. 3(*b*) comprises four high Q resonators. Using an optimisation process the response shown in FIG. 4 may be achieved. FIG. 4 shows the transmission through the reflection mode filter ($S_{21}$) and also the reflection characteristic of the reflection mode filter ($S_{11}$). The reflection mode characteristic becomes the required transmission characteristic of the electrical filter 1 after the connection to the circulator 2 of the electrical filter 1. In the transmission characteristic, the extracted pole produces the transmission zero closest to the transition frequency at 715.7 MHz. Where the corresponding reflection coefficient is less than 0.5 dB. Only 0.5 MHz above this point the return loss has reached its equiripple level of 25 dB which will be maintained after connection to the circulator which will typically achieve 30 dB isolation. This overall performance at 700 MHz can only be achieved using TE01δ modes in dielectric resonators in cavities over 100 mm in diameter.

Figure 5:
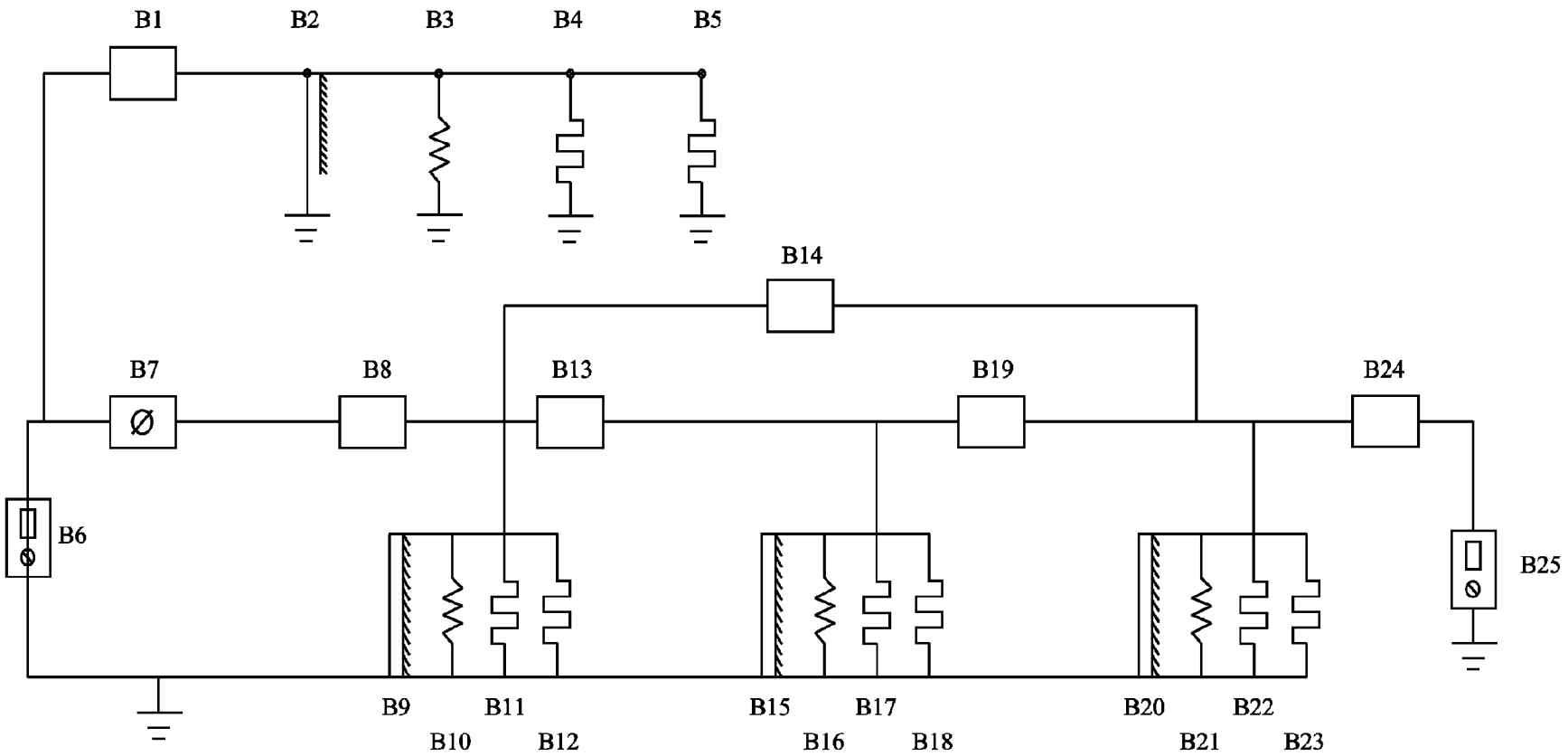
FIG. 5 shows a further reflection mode filter.
Figure 6:
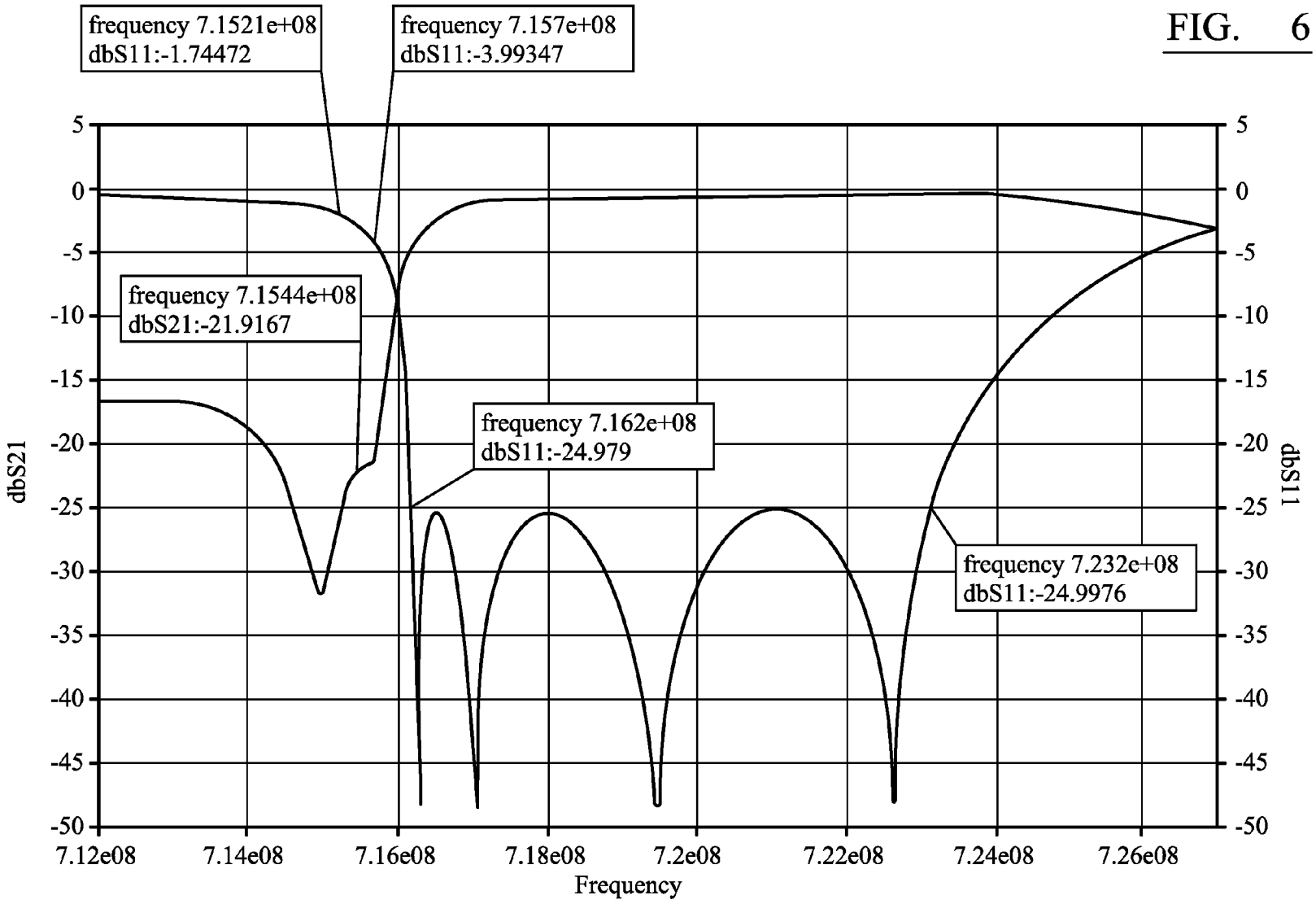
FIG. 6 shows the response of the reflection mode filter of FIG. 5.

If typical combline resonators are used, the Q factors are considerably lower as shown in the optimised circuit FIG. 5. The performance is shown in FIG. 6 where the return loss maintains its perfect zeros and 25 dB equiripple level. On transmission, the zeros have become noticeably lossy particularly the extracted pole zero. Also, the loss in both the return loss and transmission characteristic are now at the much increased level of nearly 4 dB at the band edges. However, this filter is only one sixth of the size of the high Q filter.

Figure 7:
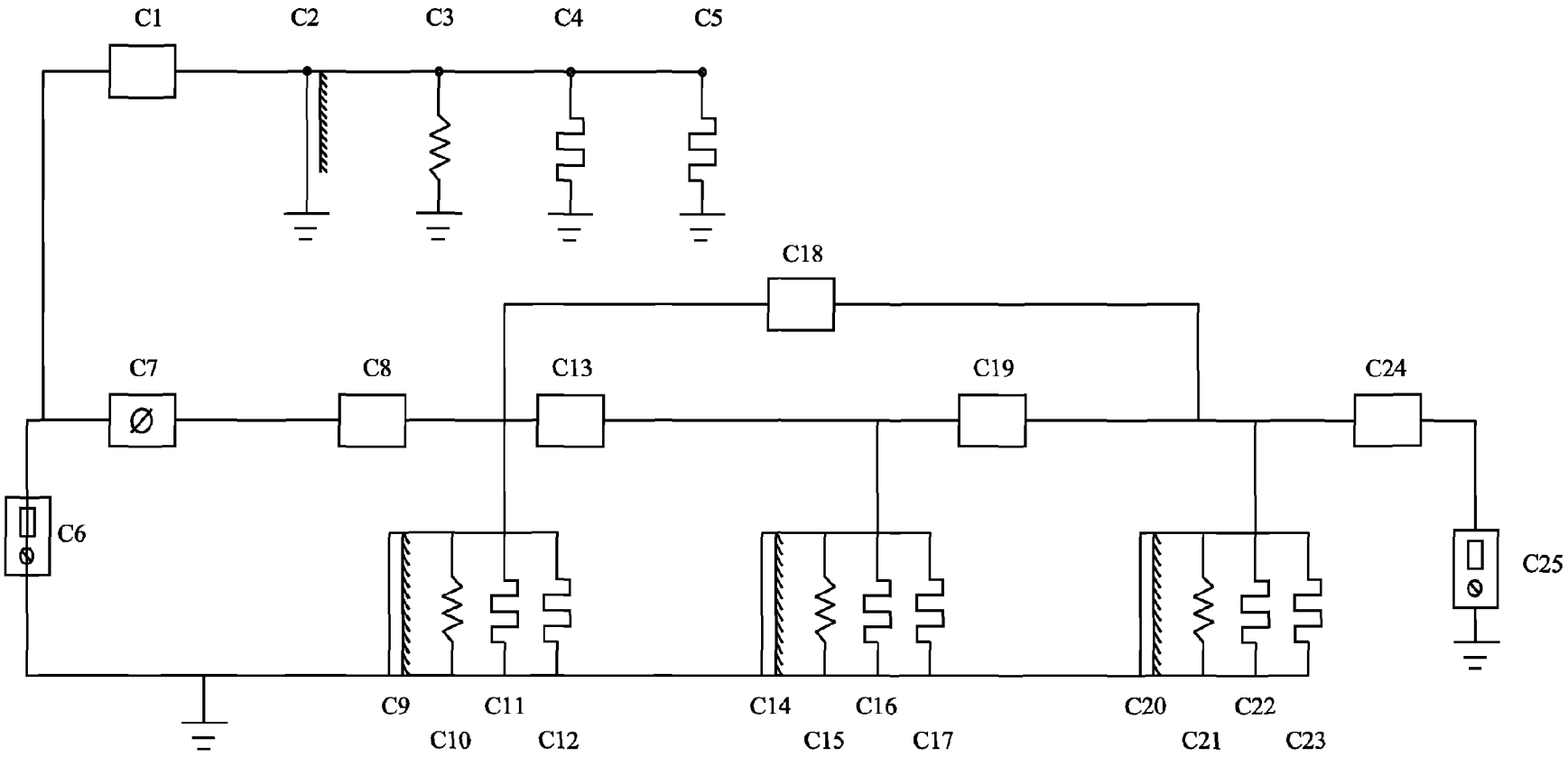
FIG. 7 shows the reflection mode filter of an electrical filter according to the invention.
Figure 8:
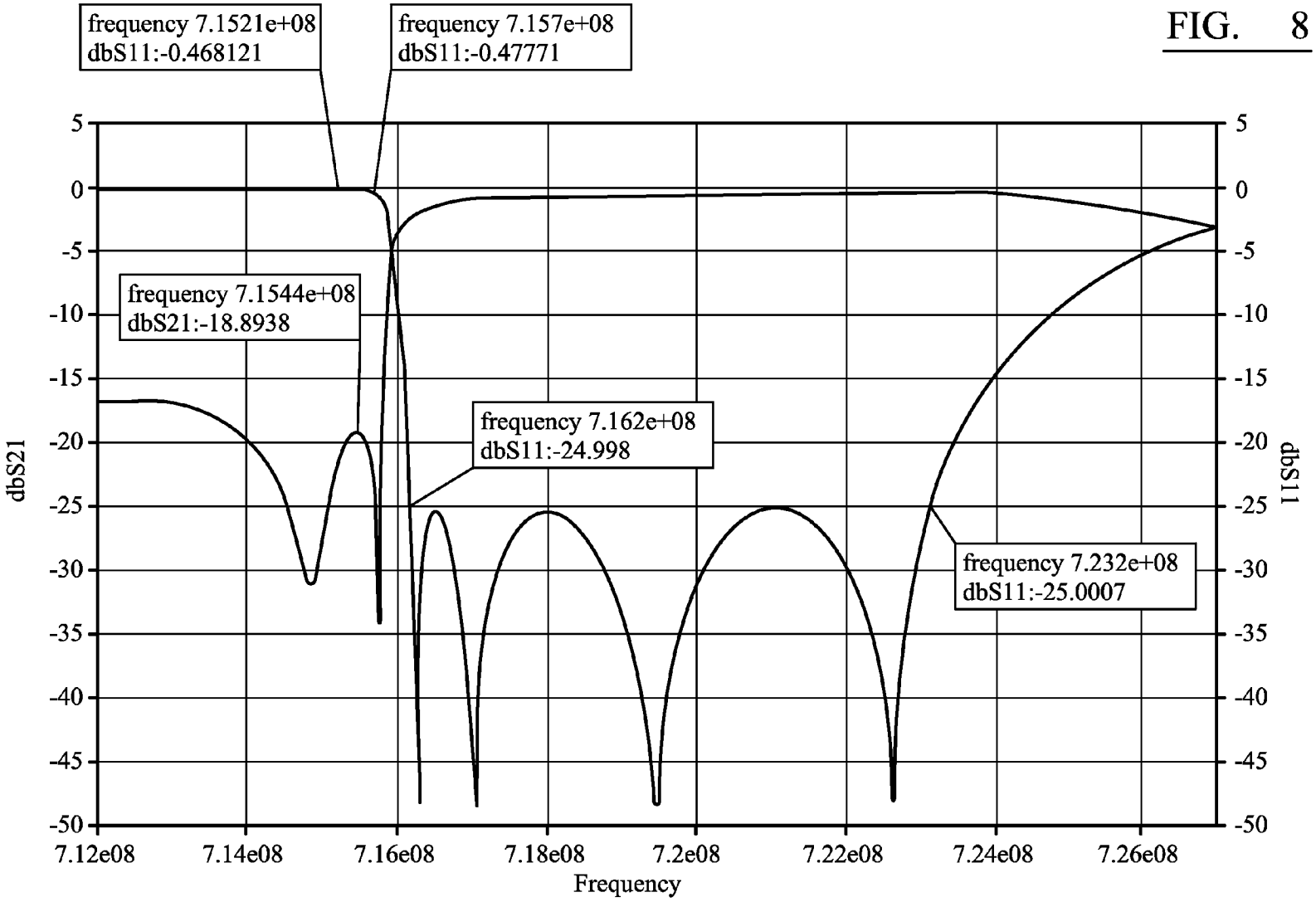
FIG. 8 shows the response of the reflection mode filter of FIG. 7.

Shown in FIG. 7 is the reflection mode filter of an electrical filter 1 according to the invention. The extracted pole resonator is a high Q resonator. The remaining three resonators are lower Q combline resonators which for this design have equal Q factors. The reflection and transmission characteristics are shown in FIG. 8. At the critical band edge points the transmission characteristic reduces to 3 dB but the reflection characteristic is below 0.5 dB. Since only the reflection mode characteristic is of interest in the design of the electrical filter 1 according to the invention the overall performance with one high Q resonator is the same as if all four resonators were high Q resonators.

Figure 9A:
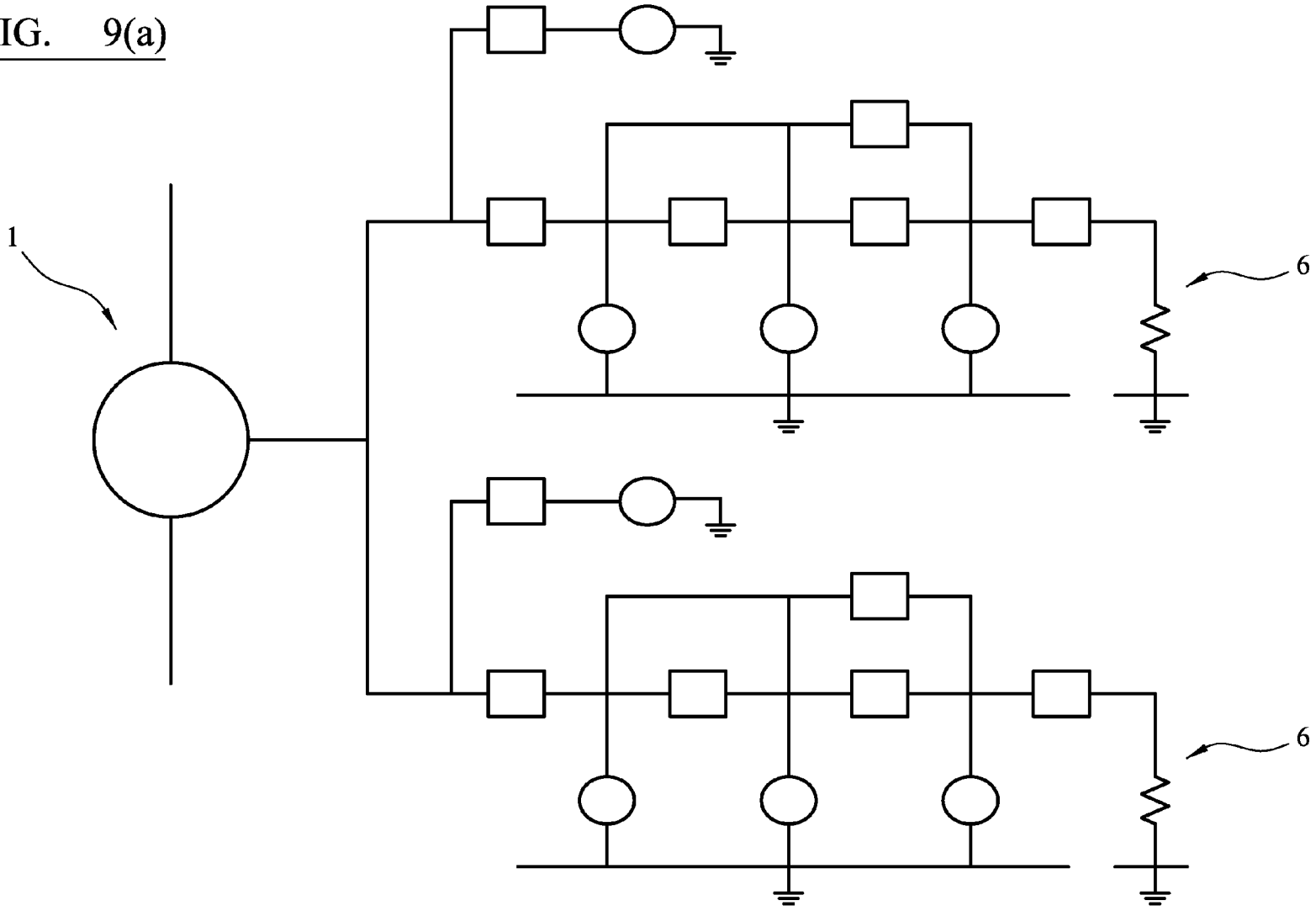
FIG. 9(*a*) shows in schematic form a further embodiment of an electrical filter according to the invention.

Shown in FIG. 9(*a*) is a further embodiment of an electrical filter 1 according to the invention. This embodiment comprises two reflection mode filters 6 connected to the second circulator port 4 of the circulator 2 in parallel. The two reflection mode filters 6 are shown in more detail in FIG. 9(*b*). One reflection mode filter 6 retains the upper band edge frequency of 715.7 MHz from the previous design. The other is an equivalent quasi highpass design derived with a band edge frequency of 698.3 MHz and the pair are diplexed at the junction with the circulator 2 and optimised to produce the required bandpass characteristic. The two individual transmission characteristics for the two reflection mode filters 6 ($S_{21}$, $S_{31}$) and the important reflection characteristic ($S_{11}$) are shown in FIG. 10.

An overall passband of 17.4 MHz has been achieved with a loss of less than 0.5 dB whilst achieving 25 dB of rejection only 0.5 MHz from both band edges using just two high Q resonators 12.

Figure 11:
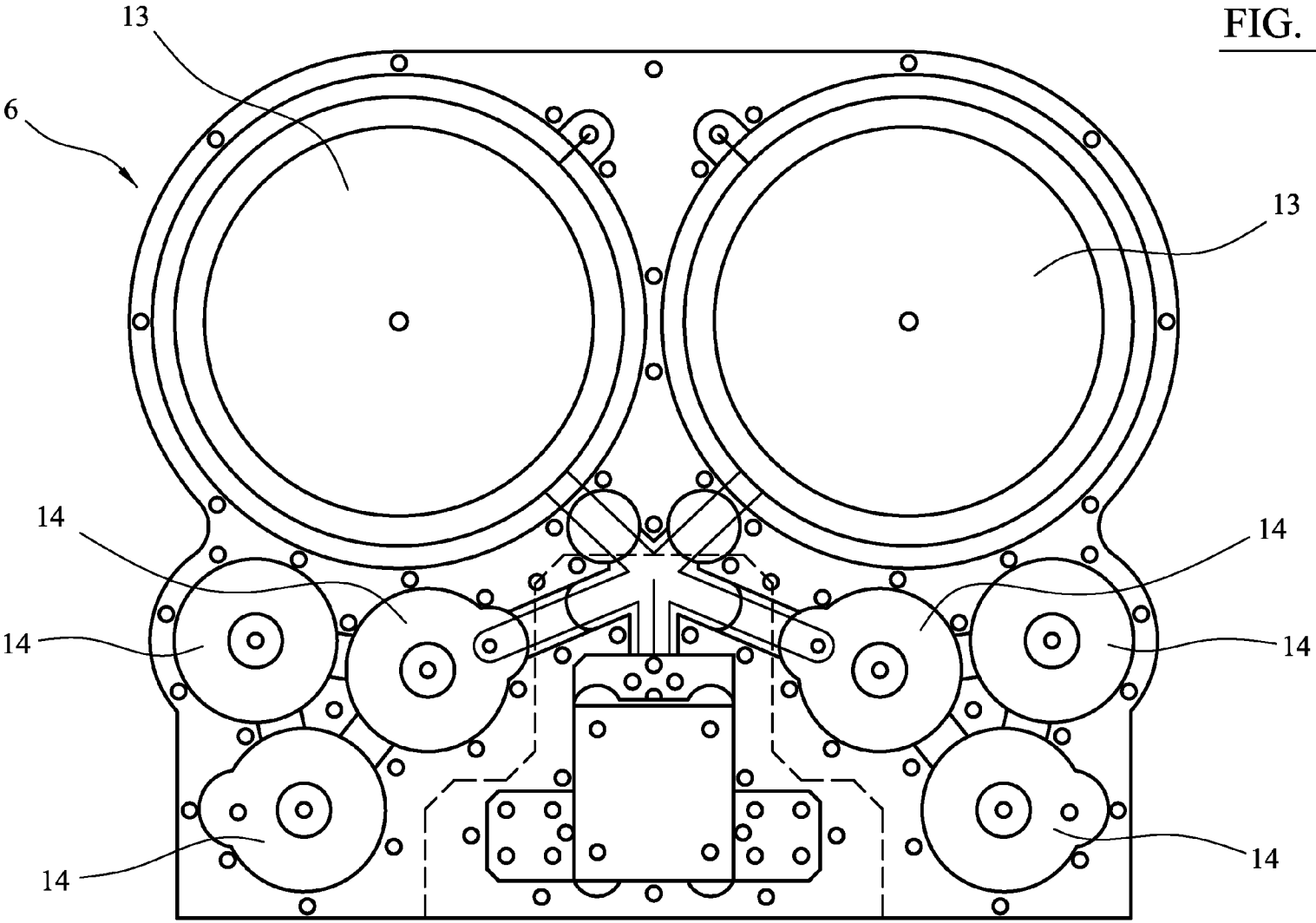
FIG. 11 shows a physical embodiment of the refection mode filters of FIG. 9(*b*); and, FIG. 12 shows the measured response of an electrical filter according to the invention including the reflection mode filters of FIG. 11.
Figure 12:
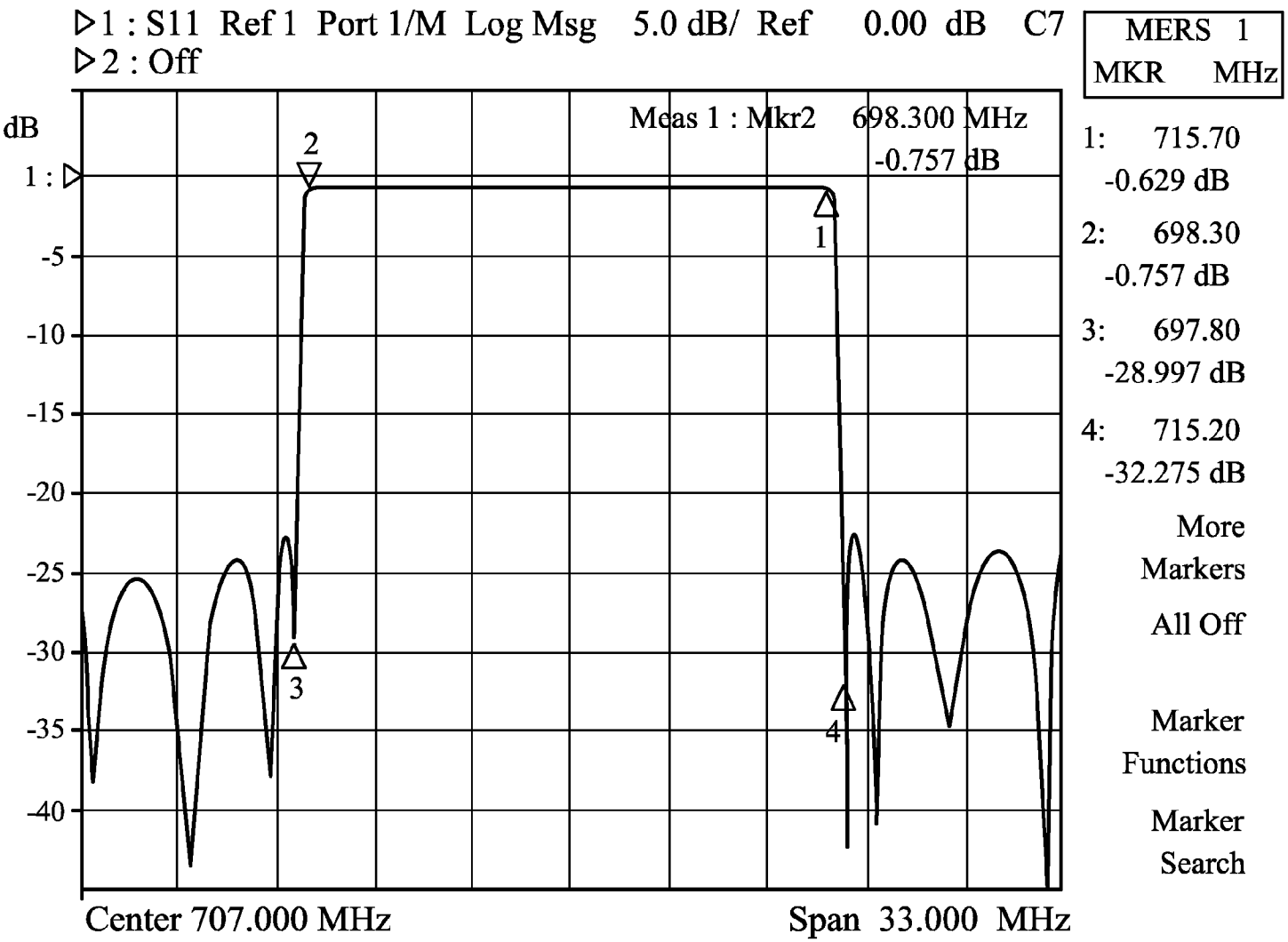

FIG. 11 shows a reflection mode filter 6 designed to meet this requirement. The two large cavities 13 house the high Q dielectric resonators 12 and the remaining six smaller cavities 14 house low Q combline resonators 9. The input and output of the reflection mode filter 6 are connected directly to a circulator 2 to produce an electrical filter according to the invention. The measured transmission characteristic of the electrical filter 1 is shown in FIG. 12 showing excellent agreement with theory. Any passband bandwidth could have been achieved with the same absolute selectivity for this degree of filter using only one high Q resonator 12 per frequency band transition.

Figure 3B:
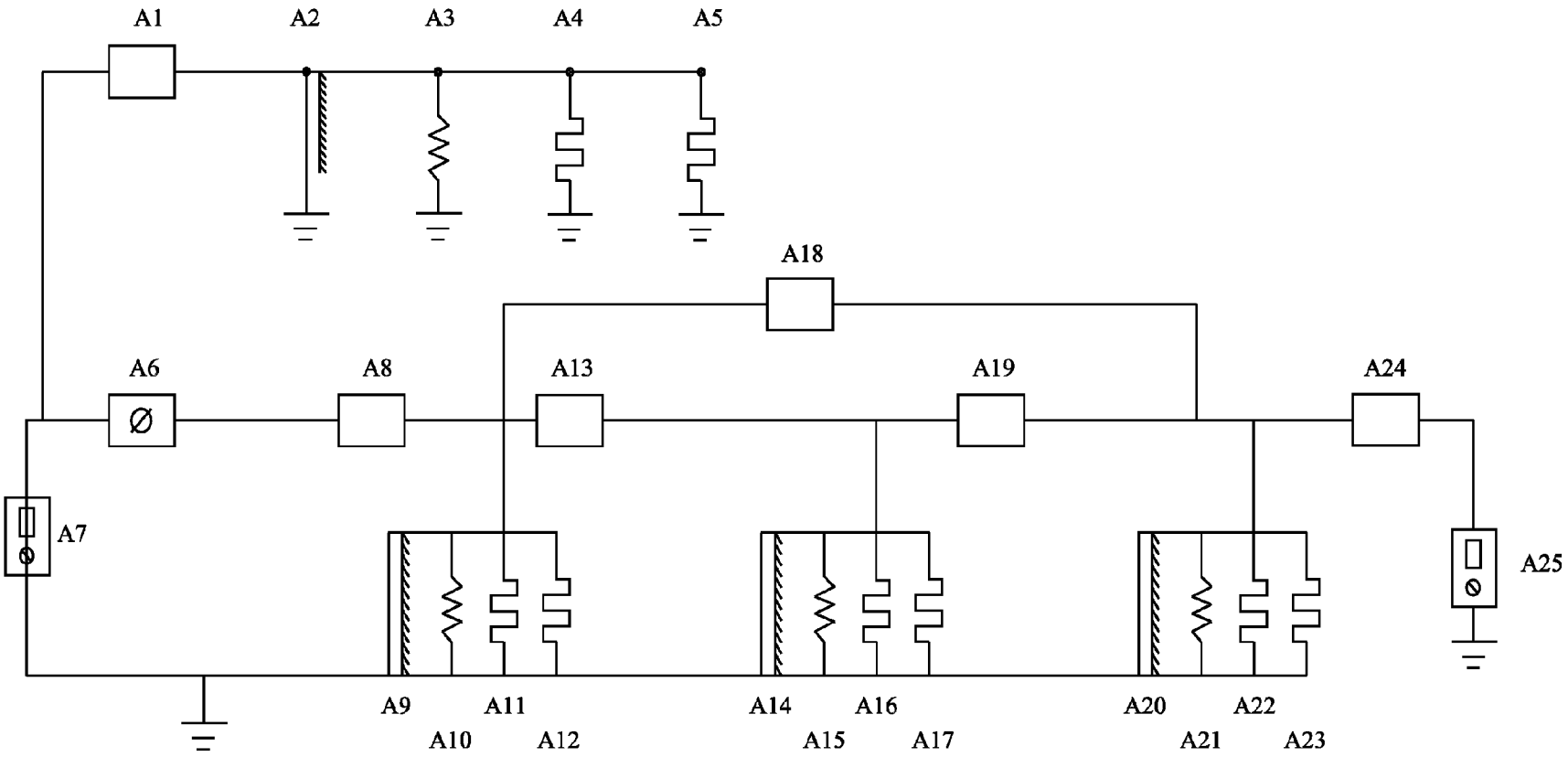
Figure 4:
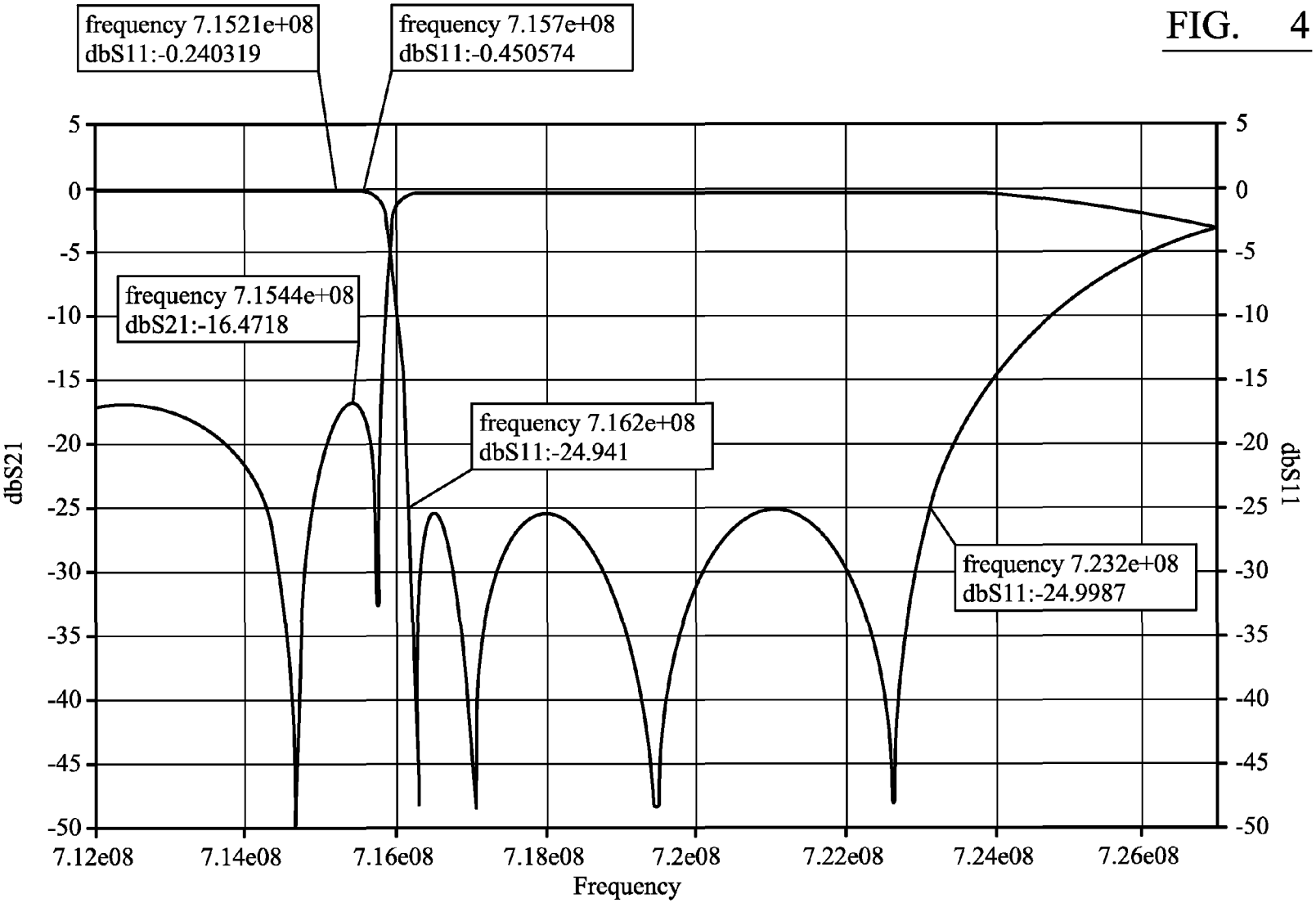
FIG. 4 shows the response of the reflection mode filter of FIG. 3(*b*)

Key for FIG. 3(b)

| Label | Text |
|---|---|
| A1 | Kf1 (Element designator) |
| (A Frequency | $Z_{ref}$ = 203.417231469 Ohm (Inverter impedance) |
| dependent impedance | $Z_f$ = 0 Ohm/Hz (Rate of change of impedance) |
| inverter) | $f_0$ = 0 Hz (Reference frequency) |
| | ($Z_{ref}$ is the impedance at $f_0$ such that at frequency f, $Z = Z_{ref} + (f - f_0) * Z_f$) |
| A2 | Line 4 (Element designator) |
| (A Transmission line) | Z = 1.09387 Ohm (Line impedance) |
| | L = 104.385 mm (Line length) |
| A3 | $R_4$ (Element designator) |
| (A Resistor) | R = 30000 Ohm |
| A4 | $B_1$ (Element designator) |
| (A Susceptance) | B = 5.56e−3 mho |
| A5 | $B_2$ (Element designator) |
| (A Susceptance) | B = −1e−3 mho |
| A6 | $X_1$ (Element designator) |
| (A Phase shifter) | Phi = 13.986409644 degrees (phase shift) |
| A7 | P1 (Element designator) |
| (A Power source/load) | Z = 50 Ohm (source/load impedance) |
| A8 | Kf0_1 (Element designator) |
| (A Frequency | $Z_{ref}$ = 75.8121282039 Ohm (Inverter impedance) |
| dependent impedance | $Z_f$ = 0 Ohm/Hz (Rate of change of impedance) |
| inverter) | $f_0$ = 0 Hz (Reference frequency) |
| A9 | Line 1 (Element designator) |
| (A Transmission line) | Z = 1.09387 Ohm (Line impedance) |
| | L = 104.385 mm (Line length) |
| A10 | $R_1$ (Element designator) |
| (A Resistor) | R = 30000 Ohm |
| A11 | $B_{01}$ (Element designator) |
| (A Susceptance) | B = −0.00600346219084 mho |
| A12 | $B_3$ (Element designator) |
| (A Susceptance) | B = −1e−3 mho |
| A13 | Kf1_1 (Element designator) |
| (A Frequency | $Z_{ref}$ = 187.474539625 Ohm (Inverter impedance) |
| dependent impedance | $Z_f$ = 0/Hz (Rate of change of impedance) |
| inverter) | $f_0$ = 0 Hz (Reference frequency) |
| A14 | Line 2 (Element designator) |
| (A Transmission line) | Z = 1.09387 Ohm (Line impedance) |
| | L = 104.385 mm (Line length) |
| A15 | $R_2$ (Element designator) |
| (A Resistor) | R = 30000 Ohm |
| A16 | $B_{02}$ (Element designator) |
| (A Susceptance) | B = 0.00164752169237 mho |
| A17 | $B_4$ (Element designator) |
| (A Susceptance) | B = −1e−3 mho |
| A18 | Kf2 (Element designator) |
| (A Frequency | $Z_{ref}$ = 180 Ohm (Inverter impedance) |
| dependent impedance | $Z_f$ = 0 Ohm/Hz (Rate of change of impedance) |
| inverter) | $f_0$ = 0 Hz (Reference frequency) |

-continued

Key for FIG. 3(b)

| Label | Text |
|---|---|
| A19 | Kf2_1 (Element designator) |
| (A Frequency | $Z_{ref}$ = 156.910751594 Ohm (Inverter impedance) |
| dependent impedance | $Z_f$ = 0 Ohm/Hz (Rate of change of impedance) |
| inverter) | $f_0$ = 0 Hz (Reference frequency) |
| A20 | Line 3 (Element designator) |
| (A Transmission line) | Z = 1.09387 Ohm (Line impedance) |
| | L = 104.385 mm (Line length) |
| A21 | $R_3$ (Element designator) |
| (A Resistor) | R = 30000 Ohm |
| A22 | $B_{03}$ (Element designator) |
| (A Susceptance) | B = −0.00419983350533 mho |
| A23 | $B_5$ (Element designator) |
| (A Susceptance) | B = −1e−3 mho |
| A24 | Kf3_1 (Element designator) |
| (A Frequency | $Z_{ref}$ = 71.6923880504 Ohm (Inverter impedance) |
| dependent impedance | $Z_f$ = 0 Ohm/Hz (Rate of change of impedance) |
| inverter) | $f_0$ = 0 Hz (Reference frequency) |
| A25 | P2 (Element designator) |
| (A Power source/load) | Z = 50 Ohm (source/load impedance) |

Key for FIG. 5

| Label | Text |
|---|---|
| B1 | Kf1 (Element designator) |
| (A Frequency | $Z_{ref}$ = 203.332878841 Ohm (Inverter impedance) |
| dependent impedance | $Z_f$ = 0 Ohm/Hz (Rate of change of impedance) |
| inverter) | $f_0$ = 0 Hz (Reference frequency) |
| B2 | Line 4 (Element designator) |
| (A Transmission line) | Z = 1.09387 Ohm (Line impedance) |
| | L = 104.38 mm (Line length) |
| B3 | $R_4$ (Element designator) |
| (A Resistor) | R = 3200 Ohm |
| B4 | $B_1$ (Element designator) |
| (A Susceptance) | B = 5.56e−3 mho |
| B5 | $B_2$ (Element designator) |
| (A Susceptance) | B = −1e−3 mho |
| B6 | P1 (Element designator) |
| (A Power source/load) | Z = 50 Ohm (source/load impedance) |
| B7 | $X_1$ (Element designator) |
| (A Phase shifter) | Phi = 21.6729753422 degrees (phase shift) |
| B8 | Kf0_1 (Element designator) |
| (A Frequency | $Z_{ref}$ = 73.4126356709 Ohm (Inverter impedance) |
| dependent impedance | $Z_f$ = 0 Ohm/Hz (Rate of change of impedance) |
| inverter) | $f_0$ = 0 Hz (Reference frequency) |
| B9 | Line 1 (Element designator) |
| (A Transmission line) | Z = 1.09387 Ohm (Line impedance) |
| | L = 104.385 mm (Line length) |
| B10 | $R_1$ (Element designator) |
| (A Resistor) | R = 3200 Ohm |
| B11 | $B_{01}$ (Element designator) |
| (A Susceptance) | B = −0.00590700538651 mho |
| B12 | $B_3$ (Element designator) |
| (A Susceptance) | B = −1e−3 mho |
| B13 | Kf1_1 (Element designator) |
| (A Frequency | $Z_{ref}$ = 188.205419231 Ohm (Inverter impedance) |
| dependent impedance | $Z_f$ = 0 Ohm/Hz (Rate of change of impedance) |
| inverter) | $f_0$ = 0 Hz (Reference frequency) |
| B14 | Kf2 (Element designator) |
| (A Frequency | $Z_{ref}$ = 180 Ohm (Inverter impedance) |
| dependent impedance | $Z_f$ = 0 Ohm/Hz (Rate of change of impedance) |
| inverter) | $f_0$ = 0 Hz (Reference frequency) |
| B15 | Line 2 (Element designator) |
| (A Transmission line) | Z = 1.09387 Ohm (Line impedance) |
| | L = 104.385 mm (Line length) |
| B16 | $R_2$ (Element designator) |
| (A Resistor) | R = 3200 Ohm |
| B17 | $B_{02}$ (Element designator) |
| (A Susceptance) | B = 0.00150737310653 mho |
| B18 | $B_4$ (Element designator) |
| (A Susceptance) | B = −1e−3 mho |

-continued

Key for FIG. 5

| Label | Text |
|---|---|
| B19 | Kf2_1 (Element designator) |
| (A Frequency | $Z_{ref}$ = 170.589503156 Ohm (Inverter impedance) |
| dependent impedance | $Z_f$ = 0 Ohm/Hz (Rate of change of impedance) |
| inverter) | $f_0$ = 0 Hz (Reference frequency) |
| B20 | Line 3 (Element designator) |
| (A Transmission line) | Z = 1.09387 Ohm (Line impedance) |
| | L = 104.385 mm (Line length) |
| B21 | $R_3$ (Element designator) |
| (A Resistor) | R = 3200 Ohm |
| B22 | $B_{03}$ (Element designator) |
| (A Susceptance) | B = −0.00444226936844 mho |
| B23 | $B_5$ (Element designator) |
| (A Susceptance) | B = −1e−3 mho |
| B24 | Kf3_1 (Element designator) |
| (A Frequency | $Z_{ref}$ = 75.4836935793 Ohm (Inverter impedance) |
| dependent impedance | $Z_f$ = 0 Ohm/Hz (Rate of change of impedance) |
| inverter) | $F_0$ = 0 Hz (Reference frequency) |
| B25 | P2 (Element designator) |
| (A Power source/load) | Z = 50 Ohm (source/load impedance) |

Key for FIG. 7

| Label | Text |
|---|---|
| C1 | Kf1 (Element designator) |
| (A Frequency | $Z_{ref}$ = 209.500569075 Ohm (Inverter impedance) |
| dependent impedance | $Z_f$ = 0 Ohm/Hz (Rate of change of impedance) |
| inverter) | $f_0$ = 0 Hz (Reference frequency) |
| C2 | Line 4 (Element designator) |
| (A Transmission line) | Z = 1.09387 Ohm (Line impedance) |
| | L = 104.385 mm (Line length) |
| C3 | $R_4$ (Element designator) |
| (A Resistor) | R = 30000 Ohm |
| C4 | $B_1$ (Element designator) |
| (A Susceptance) | B = 5.56e−3 mho |
| C5 | $B_2$ (Element designator) |
| (A Susceptance) | B = −1e−3 mho |
| C6 | P1 (Element designator) |
| (A Power source/load) | Z = 50 Ohm (source/load impedance) |
| C7 | $X_1$ (Element designator) |
| (A Phase shifter) | Phi = 15.6336551054 degrees (phase shift) |
| C8 | Kf0_1 (Element designator) |
| (A Frequency | $Z_{ref}$ = 74.1008486551 Ohm (Inverter impedance) |
| dependent impedance | $Z_f$ = 0 Ohm/Hz (Rate of change of impedance) |
| inverter) | $f_0$ = 0 Hz (Reference frequency) |
| C9 | Line 1 (Element designator) |
| (A Transmission line) | Z = 1.09387 Ohm (Line impedance) |
| | L = 104.385 mm (Line length) |
| C10 | $R_1$ (Element designator) |
| (A Resistor) | R = 3200 Ohm |
| C11 | $B_{01}$ (Element designator) |
| (A Susceptance) | B = −0.0589816751589 mho |
| C12 | $B_3$ (Element designator) |
| (A Susceptance) | B = −1e−3 mho |
| C13 | Kf1_1 (Element designator) |
| (A Frequency | $Z_{ref}$ = 186.04787522 Ohm (Inverter impedance) |
| dependent impedance | $Z_f$ = 0 Ohm/Hz (Rate of change of impedance) |
| inverter) | $f_0$ = 0 Hz (Reference frequency) |
| C14 | Line 2 (Element designator) |
| (A Transmission line) | Z = 1.09387 Ohm (Line impedance) |
| | L = 104.385 mm (Line length) |
| C15 | $R_2$ (Element designator) |
| (A Resistor) | R = 3200 Ohm |
| C16 | $B_{02}$ (Element designator) |
| (A Susceptance) | B = 0.0016397688962 mho |
| C17 | $B_4$ (Element designator) |
| (A Susceptance) | B = −1e−3 mho |
| C18 | Kf2 (Element designator) |
| (A Frequency | $Z_{ref}$ = 180 Ohm (Inverter impedance) |
| dependent impedance | $Z_f$ = 0 Ohm/Hz (Rate of change of impedance) |
| inverter) | $f_0$ = 0 Hz (Reference frequency) |

-continued

Key for FIG. 7

| Label | Text |
|---|---|
| C19 | Kf2_1 (Element designator) |
| (A Frequency | $Z_{ref}$ = 168.179168611 Ohm (Inverter impedance) |
| dependent impedance | $Z_f$ = 0 Ohm/Hz (Rate of change of impedance) |
| inverter) | $f_0$ = 0 Hz (Reference frequency) |
| C20 | Line 3 (Element designator) |
| (A Transmission line) | Z = 1.09387 Ohm (Line impedance) |
| | L = 104.385 mm (Line length) |
| C21 | $R_3$ (Element designator) |
| (A Resistor) | R = 3200 Ohm |
| C22 | $B_{03}$ (Element designator) |
| (A Susceptance) | B = −0.00434898910683 mho |
| C23 | $B_5$ (Element designator) |
| (A Susceptance) | B = −1e−3 mho |
| C24 | Kf3_1 (Element designator) |
| (A Frequency | $Z_{ref}$ = 74.9883960469 Ohm (Inverter impedance) |
| dependent impedance | $Z_f$ = 0 Ohm/Hz (Rate of change of impedance) |
| inverter) | $f_0$ = 0 Hz (Reference frequency) |
| C25 | P2 (Element designator) |
| (A Power source/load) | Z = 50 Ohm (source/load impedance) |

Figure 9B:
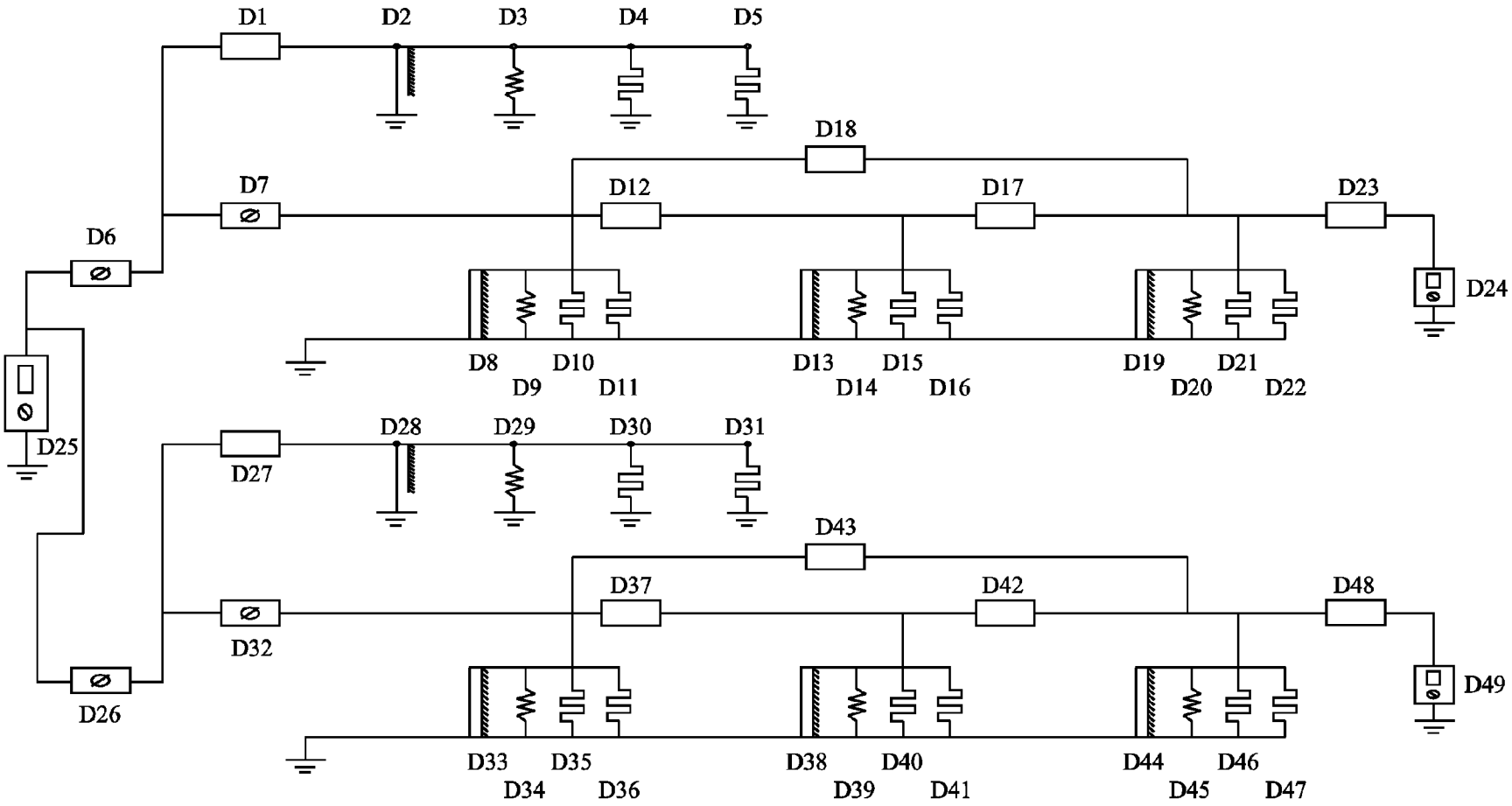
Figure 10:
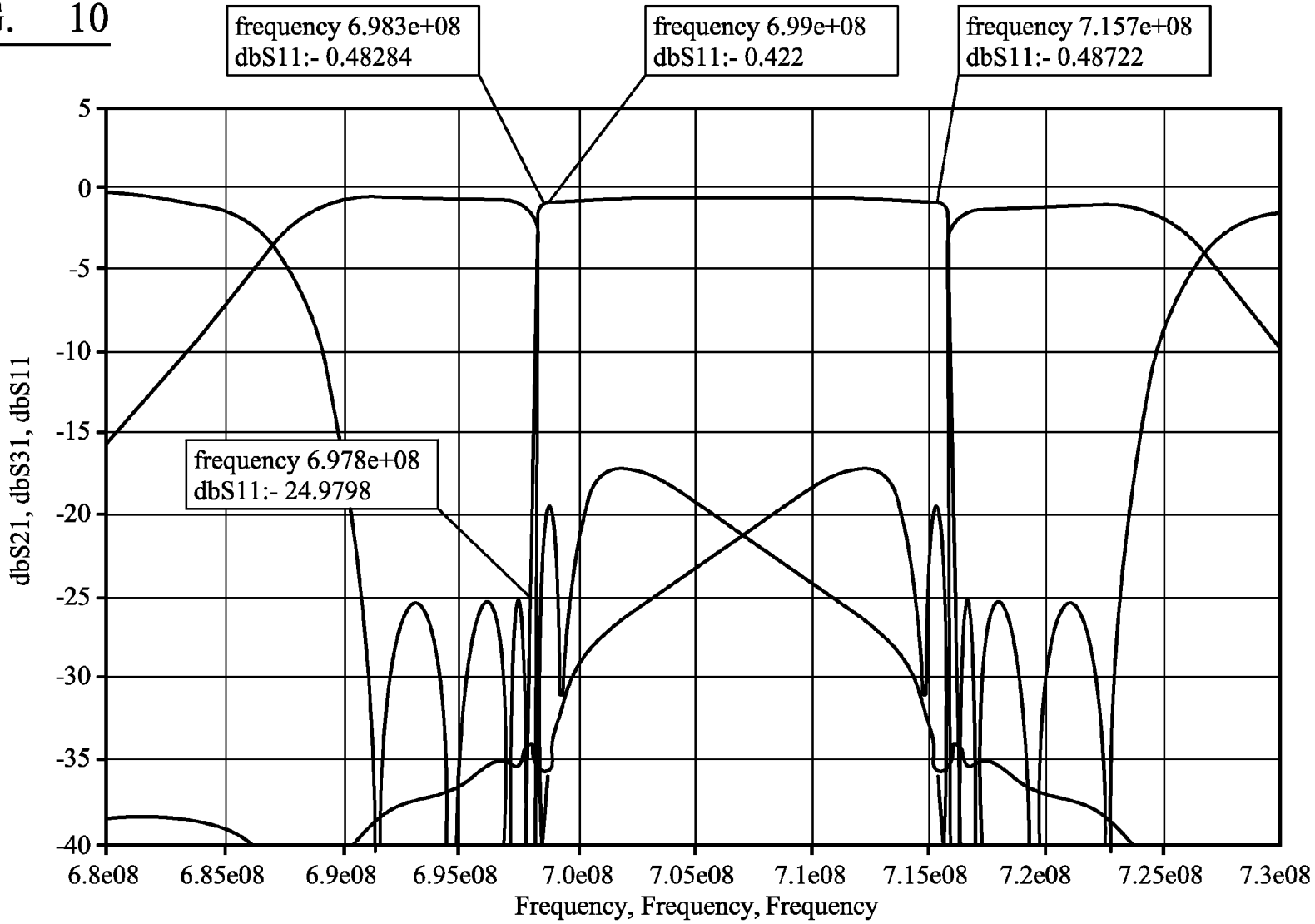
FIG. 10 shows the response of the filters of FIG. 9(*b*)

Key for FIG. 9(b)

| Label | Text |
|---|---|
| D1 | Kf1 (Element designator) |
| (A Frequency | $Z_{ref}$ = 202.26235469 Ohm (Inverter impedance) |
| dependent impedance | $Z_f$ = 0 Ohm/Hz (Rate of change of impedance) |
| inverter) | $f_o$ = 0 Hz (Reference frequency) |
| D2 | Line 4 (Element designator) |
| (A Transmission line) | Z = 1.09387 Ohm (Line impedance) |
| | L = 104.385 mm (Line length) |
| D3 | $R_1$ (Element designator) |
| (A Resistor) | R = 30000 Ohm |
| D4 | $B_5$ (Element designator) |
| (A Susceptance) | B = −5.8e−3 mho |
| D5 | $B_1$ (Element designator) |
| (A Susceptance) | B = 0.0452 mho |
| D6 | $X_3$ (Element designator) |
| (A Phase shifter) | Phi = 1.07610545762 degrees (phase shift) |
| D7 | $X_1$ (Element designator) |
| (A Phase shifter | Phi = 90 degrees (phase shift) |
| (non 50 ohm)) | $Z_{ref}$ = 76.10746977 Ohm (reference impedance) |
| D8 | Line 1 (Element designator) |
| (A Transmission line) | Z = 1.09387 Ohm (Line impedance) |
| | L = 104.385 mm (Line length) |
| D9 | $R_2$ (Element designator) |
| (A Resistor) | R = 3200 Ohm |
| D10 | $B_{01}$ (Element designator) |
| (A Susceptance) | B = 0.00719711556337 mho |
| D11 | $B_2$ (Element designator) |
| (A Susceptance) | B = 0.0452 mho |
| D12 | Kf1_1 (Element designator) |
| (A Frequency | $Z_{ref}$ = 190.671467412 Ohm (Inverter impedance) |
| dependent impedance | $Z_f$ = 0 Ohm/Hz (Rate of change of impedance) |
| inverter) | $f_0$ = 0 Hz (Reference frequency) |
| D13 | Line 2 (Element designator) |
| (A Transmission line) | Z = 1.09387 Ohm (Line impedance) |
| | L = 104.385 mm (Line length) |
| D14 | $R_3$ (Element designator) |
| (A Resistor) | R = 3200 Ohm |
| D15 | $B_{02}$ (Element designator) |
| (A Susceptance) | B = −0.0017731555651 mho |
| D16 | $B_3$ (Element designator) |
| (A Susceptance) | B = 0.0452 mho |
| D17 | Kf2_1 (Element designator) |
| (A Frequency | $Z_{ref}$ = 164.672515082 Ohm (Inverter impedance) |
| dependent impedance | $Z_f$ = 0 Ohm/Hz (Rate of change of impedance) |
| inverter) | $f_0$ = 0 Hz (Reference frequency) |
| D18 | Kf2 (Element designator) |
| (A Frequency | $Z_{ref}$ = 1850 Ohm (Inverter impedance) |
| dependent impedance | $Z_f$ = 0 Ohm/Hz (Rate of change of impedance) |
| inverter) | $f_0$ = 0 Hz (Reference frequency) |

-continued

Key for FIG. 9(b)

| Label | Text |
|---|---|
| D19 | Line 3 (Element designator) |
| (A Transmission line) | Z = 1.09387 Ohm (Line impedance) |
| | L = 104.385 mm (Line length) |
| D20 | $R_4$ (Element designator) |
| (A Resistor) | R = 3200 Ohm |
| D21 | $B_{03}$ (Element designator) |
| (A Susceptance) | B = 0.0041707254128 mho |
| D22 | $B_4$ (Element designator) |
| (A Susceptance) | B = 0.0452 mho |
| D23 | Kf3_2 (Element designator) |
| (A Frequency | $Z_{ref}$ = 74.2844992762 Ohm (Inverter impedance) |
| dependent impedance | $Z_f$ = 0 Ohm/Hz (Rate of change of impedance) |
| inverter) | $f_0$ = 0 Hz (Reference frequency) |
| D24 | P1 (Element designator) |
| (A Power source/load) | Z = 50 Ohm (source/load impedance) |
| D25 | P2 (Element designator) |
| (A Power source/load) | Z = 50 Ohm (source/load impedance) |
| D26 | $X_4$ (Element designator) |
| (A Phase shifter) | Phi = 1.37301345975 degrees (phase shift) |
| D27 | Kf3 (Element designator) |
| (A Frequency | $Z_{ref}$ = 203.671992373 Ohm (Inverter impedance) |
| dependent impedance | $Z_f$ = 0 Ohm/Hz (Rate of change of impedance) |
| inverter) | $f_0$ = 0 Hz (Reference frequency) |
| D28 | Line 8 (Element designator) |
| (A Transmission line) | Z = 1.09387 Ohm (Line impedance) |
| | L = 104.385 mm (Line length) |
| D29 | $R_5$ (Element designator) |
| (A Resistor) | R = 30000 Ohm |
| D30 | $B_{10}$ (Element designator) |
| (A Susceptance) | B = 5.6e−3 mho |
| D31 | B6 (Element designator) |
| (A Susceptance) | B = −1e−3 mho |
| D32 | $X_2$ (Element designator) |
| (A Phase shifter | Phi = 90 degrees (phase shift) |
| (non 50 ohm)) | $Z_{ref}$ = 74.42366058 Ohm (reference impedance) |
| D33 | Line 5 (Element designator) |
| (A Transmission line) | Z = 1.09387 Ohm (Line impedance) |
| | L = 104.385 mm (Line length) |
| D34 | $R_6$ (Element designator) |
| (A Resistor) | R = 3200 Ohm |
| D35 | $B_{04}$ (Element designator) |
| (A Susceptance) | B = −0.00764056726784 mho |
| D36 | $B_7$ (Element designator) |
| (A Susceptance) | B = −1e−3 mho |
| D37 | Kf1_2 (Element designator) |
| (A Frequency | $Z_{ref}$ = 189.303454589 Ohm (Inverter impedance) |
| dependent impedance | $Z_f$ = 0 Ohm/Hz (Rate of change of impedance) |
| inverter) | $f_0$ = 0 Hz (Reference frequency) |
| D38 | Line 6 (Element designator) |
| (A Transmission line) | Z = 1.09387 Ohm (Line impedance) |
| | L = 104.385 mm (Line length) |
| D39 | $R_7$ (Element designator) |
| (A Resistor) | R = 3200 Ohm |
| D40 | $B_{05}$ (Element designator) |
| (A Susceptance) | B = 0.00157252021734 mho |
| D41 | $B_8$ (Element designator) |
| (A Susceptance) | B = −1e−3 mho |
| D42 | Kf2_2 (Element designator) |
| (A Frequency | $Z_{ref}$ = 166.348667245 Ohm (Inverter impedance) |
| dependent impedance | |
| inverter) | |
| D43 | Kf4 (Element designator) |
| (A Frequency | $Z_{ref}$ = 185 Ohm (Inverter impedance) |
| dependent impedance | $Z_f$ = 0 Ohm/Hz (Rate of change of impedance) |
| inverter) | $f_0$ = 0 Hz (Reference frequency) |
| D44 | Line 7 (Element designator) |
| (A Transmission line) | Z = 1.09387 Ohm (Line impedance) |
| | L = 104.385 mm (Line length) |
| D45 | $R_8$ (Element designator) |
| (A Resistor) | R = 3200 Ohm |
| D46 | $B_{06}$ (Element designator) |
| (A Susceptance) | B = −0.00441377677015 mho |
| D47 | $B_9$ (Element designator) |
| (A Susceptance) | B = −1e−3 mho |

-continued

Key for FIG. 9(b)

| Label | Text |
|---|---|
| D48 | Kf3_2 (Element designator) |
| (A Frequency | $Z_{ref}$ = 74.7299827356 Ohm (Inverter impedance) |
| dependent impedance | $Z_f$ = 0 Ohm/Hz (Rate of change of impedance) |
| inverter) | $f_0$ = 0 Hz (Reference frequency) |
| D49 | P3 (Element designator) |
| (A Power source/load) | Z = 50 Ohm (source/load impedance) |

The invention claimed is:

1. An electrical filter for filtering an electrical signal, the filter having a transmission characteristic comprising a first band edge having a band edge transition frequency, the filter comprising:

a circulator having a first circulator port for receiving the electrical signal to be filtered, the circulator being adapted to transfer the electrical signal to be filtered received at the first circulator port to a second circulator port and being further adapted to transfer the electrical signal to be filtered received at the second circulator port to a third circulator port; and, a reflection mode filter connected to the second circulator port;

the reflection mode filter comprising:

a filter network comprising a single resonator, the filter network having a network input connected to the second circulator port; and, a further resonator connected to the network input, the further resonator being arranged to provide an extracted pole providing a transmission zero closest to the band edge transition frequency;

wherein the further resonator has a higher Q than the Q of the single resonator of the filter network.

2. An electrical filter as claimed in claim 1, further comprising an electrical signal generator connected to the first circulator port of the circulator.

3. An electrical filter as claimed in claim 1, wherein the filter network comprises at least one impedance inverter.

4. An electrical filter as claimed in claim 1 comprising a second reflection mode filter connected to the same second circulator port, the second reflection mode filter comprising a plurality of resonators, the resonators of the second reflection mode filter being adapted such that the transmission characteristic of the electrical filter comprises the first band edge having the band edge transition and a second band edge spaced apart from the first band edge to define a passband therebetween.

5. An electrical filter as claimed in claim 1, wherein the single resonator of the filter network is a combline resonator.

6. An electrical filter as claimed in claim 1, wherein the filter network comprises at least one resistor.

7. An electrical filter as claimed in claim 6, wherein the at least one resistor is a load resistor.

8. An electrical filter for filtering an electrical signal, the filter having a transmission characteristic comprising a first band edge having a band edge transition frequency, the filter comprising:

a circulator having a first circulator port for receiving the electrical signal to be filtered, the circulator being adapted to transfer the electrical signal to be filtered received at the first circulator port to a second circulator port and being further adapted to transfer the electrical signal to be filtered received at the second circulator port to a third circulator port; and, a first reflection mode filter connected to the second circulator port;

the first reflection mode filter comprising:

a filter network comprising at least one resonator, the filter network having a network input connected to the second circulator port; and, a further resonator connected to the network input, the further resonator being arranged to provide an extracted pole providing a transmission zero closest to the band edge transition frequency;

wherein the further resonator has a higher Q than the Q of at least one of the at least one resonator of the filter network; and a second reflection mode filter connected to the same second circulator port, the second reflection mode filter comprising a plurality of resonators, the resonators of the second reflection mode filter being adapted such that the transmission characteristic of the electrical filter comprises the first band edge having the band edge transition frequency and a second band edge spaced apart from the first band edge to define a passband therebetween.

9. An electrical filter as claimed in claim 8, wherein the at least one resonator of the filter network comprises a single resonator.

10. An electrical filter as claimed in claim 9, wherein the single resonator of the filter network is a combline resonator.

11. An electrical filter as claimed in claim 8, wherein the at least one resonator of the filter network comprises a plurality of resonators.

12. An electrical filter as claimed in claim 11, wherein the Q of the further resonator is higher than the Q of each of the plurality of resonators of the filter network.

13. An electrical filter as claimed in claim 11, wherein at least one of the plurality of resonators of the filter network is a combline resonator.

14. An electrical filter as claimed in claim 8, further comprising an electrical signal generator connected to the first circulator port of the circulator.

15. An electrical filter as claimed in claim 8, wherein the filter network comprises at least one resistor.

16. An electrical filter as claimed in claim 15, wherein the at least one resistor is a load resistor.

17. An electrical filter as claimed in claim 8, wherein the filter network comprises at least one impedance inverter.

18. An electrical filter as claimed in claim 8, wherein the at least one resonator of the filter network comprises three resonators.

* * * * *